US007832754B2

(12) United States Patent
Girard et al.

(10) Patent No.: US 7,832,754 B2
(45) Date of Patent: Nov. 16, 2010

(54) DUAL-CONTROL BINDING DEVICE

(75) Inventors: François Girard, Veyrier du Lac (FR); Eddy Yelovina, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 276 days.

(21) Appl. No.: 11/367,355

(22) Filed: Mar. 6, 2006

(65) Prior Publication Data

US 2006/0197312 A1 Sep. 7, 2006

(30) Foreign Application Priority Data

Mar. 7, 2005 (FR) ..... 05 02235

(51) Int. Cl.
*A63C 9/00* (2006.01)

(52) U.S. Cl. ..... 280/615; 280/613; 280/623

(58) Field of Classification Search ..... 280/611, 280/613, 623, 11.3, 11.33, 615
See application file for complete search history.

(56) References Cited

U.S. PATENT DOCUMENTS

| | | | | |
|---|---|---|---|---|
| 3,810,644 | A * | 5/1974 | Beyl | 280/632 |
| 3,909,023 | A * | 9/1975 | Zoor | 280/631 |
| 4,153,271 | A * | 5/1979 | Buttner | 280/615 |
| 4,214,773 | A * | 7/1980 | Wittmann | 280/631 |
| 4,309,044 | A * | 1/1982 | Schmidt | 280/615 |
| 4,457,534 | A * | 7/1984 | Richert | 280/631 |
| 4,611,414 | A * | 9/1986 | Vogel | 36/118.3 |
| 5,026,087 | A * | 6/1991 | Wulf et al. | 36/117.4 |
| 5,052,710 | A | 10/1991 | Provence et al. | |
| 5,092,620 | A | 3/1992 | Girault et al. | |
| 5,224,730 | A * | 7/1993 | Provence et al. | 280/615 |
| 5,338,053 | A | 8/1994 | Hauglin | |
| 5,609,347 | A * | 3/1997 | Dressel | 280/14.23 |
| 5,669,622 | A * | 9/1997 | Miller | 280/615 |
| 5,671,941 | A | 9/1997 | Girard | |
| 5,794,963 | A | 8/1998 | Girard | |
| 5,957,478 | A | 9/1999 | Vigny | |
| 6,017,050 | A | 1/2000 | Girard | |
| 6,027,135 | A | 2/2000 | Hauglin | |
| 6,279,924 | B1 * | 8/2001 | Murphy et al. | 280/14.23 |
| 6,289,610 | B1 | 9/2001 | Girard et al. | |
| 6,390,493 | B1 * | 5/2002 | Hauglin | 280/615 |
| 6,435,537 | B2 | 8/2002 | Veux | |
| 6,644,683 | B1 | 11/2003 | Hauglin et al. | |
| 6,811,177 | B2 | 11/2004 | Lancon et al. | |
| 6,986,526 | B2 | 1/2006 | Haughlin | |
| 7,219,917 | B2 * | 5/2007 | Walker et al. | 280/613 |
| 2004/0056449 | A1 | 3/2004 | Girard et al. | |

(Continued)

FOREIGN PATENT DOCUMENTS

DE 10 2004 018 296 A1 2/2005

(Continued)

*Primary Examiner*—S. Joseph Morano
*Assistant Examiner*—Katy Meyer
(74) *Attorney, Agent, or Firm*—Greenblum & Bernstein, P.L.C.

(57) ABSTRACT

A device for binding an article of footwear to a sports article, such as a binding for securing a boot to a cross-country ski, including a locking mechanism adapted to cooperate with a connecting member of the article of footwear, and including a user-manipulable opening system for controlling the opening of the mechanism, the opening system being directly or indirectly manipulable independently according to at least two distinct directions of manipulation for controlling the opening of the mechanism.

40 Claims, 8 Drawing Sheets

U.S. PATENT DOCUMENTS

2004/0262886 A1 12/2004 Girard

FOREIGN PATENT DOCUMENTS

| | | | |
|---|---|---|---|
| EP | 0 551 899 | A1 | 7/1993 |
| EP | 0 679 415 | A1 | 11/1995 |
| EP | 0 768 103 | A1 | 4/1997 |
| EP | 0 913 102 | A1 | 5/1999 |
| EP | 0 913 103 | A1 | 5/1999 |
| EP | 0 904 139 | B1 | 2/2003 |
| EP | 1 492 598 | B1 | 8/2005 |
| FR | 2 638 974 | A1 | 5/1990 |
| FR | 2 645 764 | A1 | 10/1990 |
| FR | 2 733 159 | A1 | 10/1996 |
| FR | 2 738 158 | A1 | 3/1997 |
| FR | 2 742 060 | A1 | 6/1997 |
| FR | 2 776 200 | A1 | 9/1999 |
| FR | 2 834 473 | A1 | 7/2003 |
| FR | 2 843 310 | A1 | 2/2004 |
| FR | 2 853 253 | A1 | 10/2004 |
| FR | 2 856 312 | A1 | 12/2004 |
| WO | WO-00/04965 | A1 | 2/2000 |
| WO | WO-01/93963 | A1 | 12/2001 |
| WO | WO-03/084620 | A1 | 10/2003 |

* cited by examiner

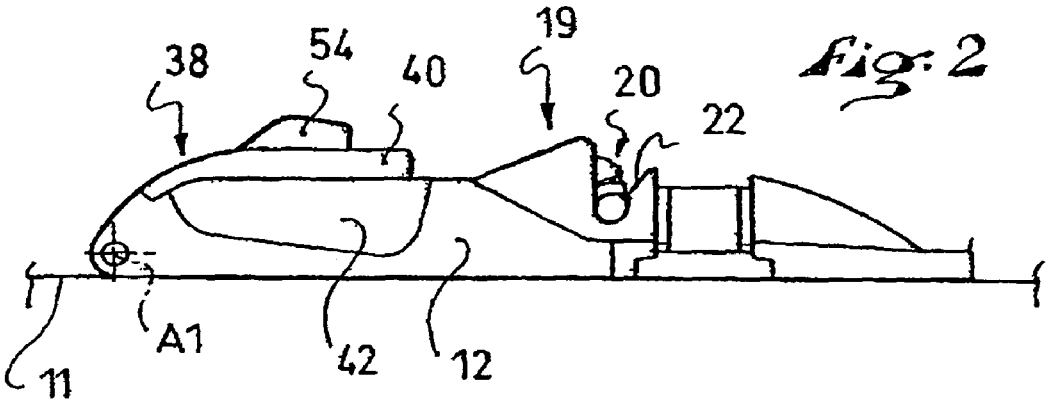
Fig: 2
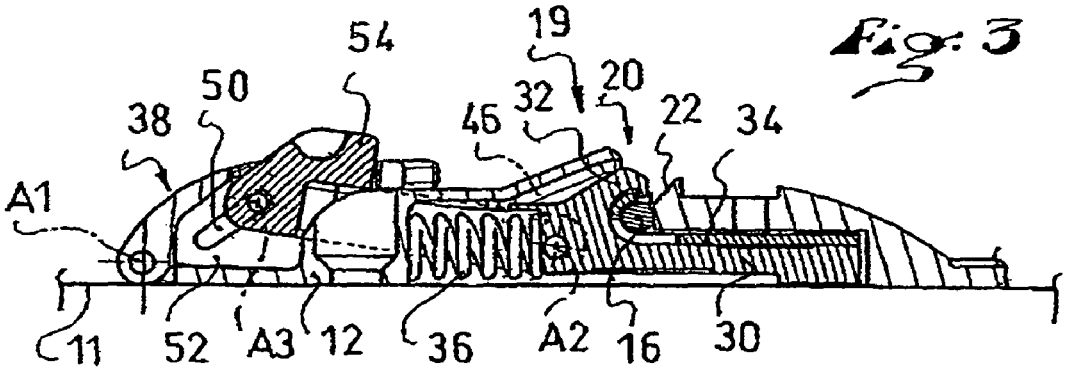
Fig: 3
Fig: 4
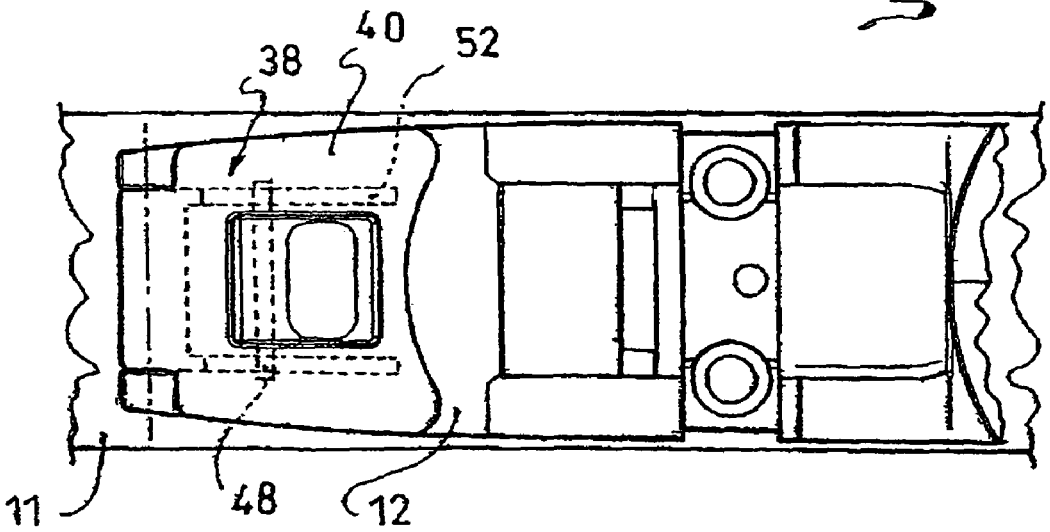

DUAL-CONTROL BINDING DEVICE

CROSS-REFERENCE TO RELATED APPLICATION

This application claims priority under 35 U.S.C. §119 of French Patent Application No. 05.02235, filed on Mar. 7, 2005, the disclosure of which is hereby incorporated by reference thereto in its entirety.

BACKGROUND OF THE INVENTION

1. Field of the Invention

The invention relates to the field of devices for binding an article of footwear to a gliding apparatus.

The invention is more particularly related to a device for binding an article of footwear to a gliding apparatus, such as a ski, snowshoe, ice skate, or roller skate, etc., and, more specifically, to a device for binding a cross-country ski boot to a corresponding ski.

2. Description of Background and Relevant Information

Bindings of the type to which the invention is directed, in every instance, include a locking mechanism adapted to cooperate with a connecting member of the article of footwear, and a user-manipulable system for controlling the opening mechanism.

The locking mechanism can be of very varied types, so can the corresponding connecting member of the article of footwear.

In numerous binding devices, especially for cross-country, touring, or telemark skis, the connecting member of the boot is constituted of a connecting axle, which is adapted to be lodged in a jaw. Such a system is disclosed, for example, in the patent documents FR-2 638 974, FR-2 645 764, FR-2 834 473, FR-2 742 060, FR-2 856 312, FR-2 738 158, EP-551 899, EP-904 139, and in family members U.S. Pat. No. 5,052,710; U.S. Pat. No. 5,092,620; U.S. Pat. No. 6,811,177; US-200410262886; U.S. Pat. No. 5,794,963; U.S. Pat. No. 5,338,053; U.S. Pat. No. 6,027,135.

In other devices, the connecting member of the article of footwear, hereafter "boot" or "shoe," is constituted of two parts: either two parallel connecting axles, as disclosed in EP-679 415, FR-2 853 253, FR-2 843 310, WO 01/93963, and in family members U.S. Pat. No. 5,671,941; US-2004/0056449; U.S. Pat. No. 6,986,526, or a front-end stop and a rear catching latch, as disclosed in FR-2 776 200, FR-2 733 159, EP-1 100 601, DE-10 2004 018 296, and in family members U.S. Pat. No. 6,435,537; U.S. Pat. No. 5,957,478; U.S. Pat. No. 6,644,683.

Other devices are disclosed, for example, in the document EP-1 492 598.

All of the aforementioned devices include a locking mechanism provided with at least one movable element adapted to cooperate with the connecting member of the boot. This movable element can be moved from an active position, in which it carries out the locking between the connecting member and the binding device, to an unlocking position, in which it allows the connecting member, and thus also the boot, to be separated from the binding device.

Some of the known binding devices are of the "step-in" type (also referred to as semi-automatic or self-locking) inasmuch as they allow locking the connecting member to the binding device without any other action from the user than that of bringing the connecting member closer to the binding device and exerting a certain force to trigger the locking. In most cases, self-locking is triggered by the interaction of the connecting member (or another part of the boot) with a corresponding element of the binding device. Some devices require bringing the binding in an open state (by means of a distinct operation, most of the time manual), the interaction triggering only the closure of the locking mechanism (c.f. for example, EP-1 100 601). In other devices, the locking mechanism is in a closed state and the interaction triggers the opening of the mechanism, which then closes itself back automatically, generally due to the action of an elastic member (c.f. for example FR-2 645 764).

In other devices, the user must carry out a specific opening and closing operation for both putting on and taking off the boot.

In every instance, however, the locking mechanisms include an opening system that allows the user to control the mechanism towards its open state (or unlocked state) in order to enable the user to free the boot, at will and with a reasonable amount of force, from the binding device. The opening system (generally a lever, a pull rod or a button) must therefore be brought from a first to a second position to trigger the unlocking. The user manipulates this system either by hand or with the help of an accessory, such as a ski pole, for example. This manipulation could be a two-step manipulation with a pre-opening (consisting, for example, in triggering the lifting of a prehension member), then an actual opening (consisting in manipulating the prehension member previously updated). In the prior art, for a given opening system, the opening position is always the same and the manipulation direction of the opening system to trigger the unlocking is always the same.

For various reasons, due, especially, to size, weight and reliability considerations and to the necessity of not allowing an ill-timed opening of the binding device, opening systems are not always purely ergonomic or even substantially ergonomic in most situations, and are not sufficiently ergonomic in situations in which the user is placed.

Indeed, in the case of bindings adapted for use by children, the system can sometimes be rather child-friendly for the child using the binding device, but not easily usable by another person, for example an adult wanting to help the child unlock the binding system. In other cases, the binding system can be particularly difficult to manipulate by its user when the user has fallen and is trying to release, whereas when used normally, the system gives complete satisfaction.

SUMMARY OF THE INVENTION

An object of the invention is to provide a new construction for a binding device, with an easier manipulation than in all other cases.

For this purpose, the invention provides for a device for binding an article of footwear to a sport apparatus of the type including a locking mechanism adapted to cooperate with a connecting member of the article of footwear and of the type including a user-manipulable system for controlling the opening of the mechanism, wherein the opening system can be manipulated directly or indirectly, independently according to either of at least two distinct directions of manipulation for controlling the opening mechanism. As a result, the user or a person assisting the user can choose the control mode the most appropriate for him/her.

According to another characteristic of the invention, the opening system includes at least two distinct control members that are each manipulable according to one of the at least two directions of manipulation, thus favoring the possibility of adapting the geometry of the control member to the mode of manipulation, of the two modes, which is believed to be better or which, in any event, is preferred. In this case, one can provide for the opening system to include a first control member, which, when manipulated according to a first direction, controls directly the opening of the locking mechanism, and a second control member, which, when manipulated according to a second direction of manipulation, controls the opening of the mechanism by means of the first control member.

As an alternative, the opening system can include a single control member that is manipulable according to the at least two distinct directions of manipulation, thus favoring simplicity, low manufacturing cost, and operating reliability of the device.

BRIEF DESCRIPTION OF THE DRAWINGS

Other characteristics and advantages of the invention will become apparent upon reading the following description, with reference to the attached drawings, and in which:

FIG. 2 is a side view of the front portion of the binding device of FIG. 1;

FIG. 3 is a longitudinal cross-sectional view of the front portion of FIG. 2;

FIG. 4 is a top view of the front portion of FIG. 2;

DETAILED DESCRIPTION OF THE INVENTION

Figure 1:
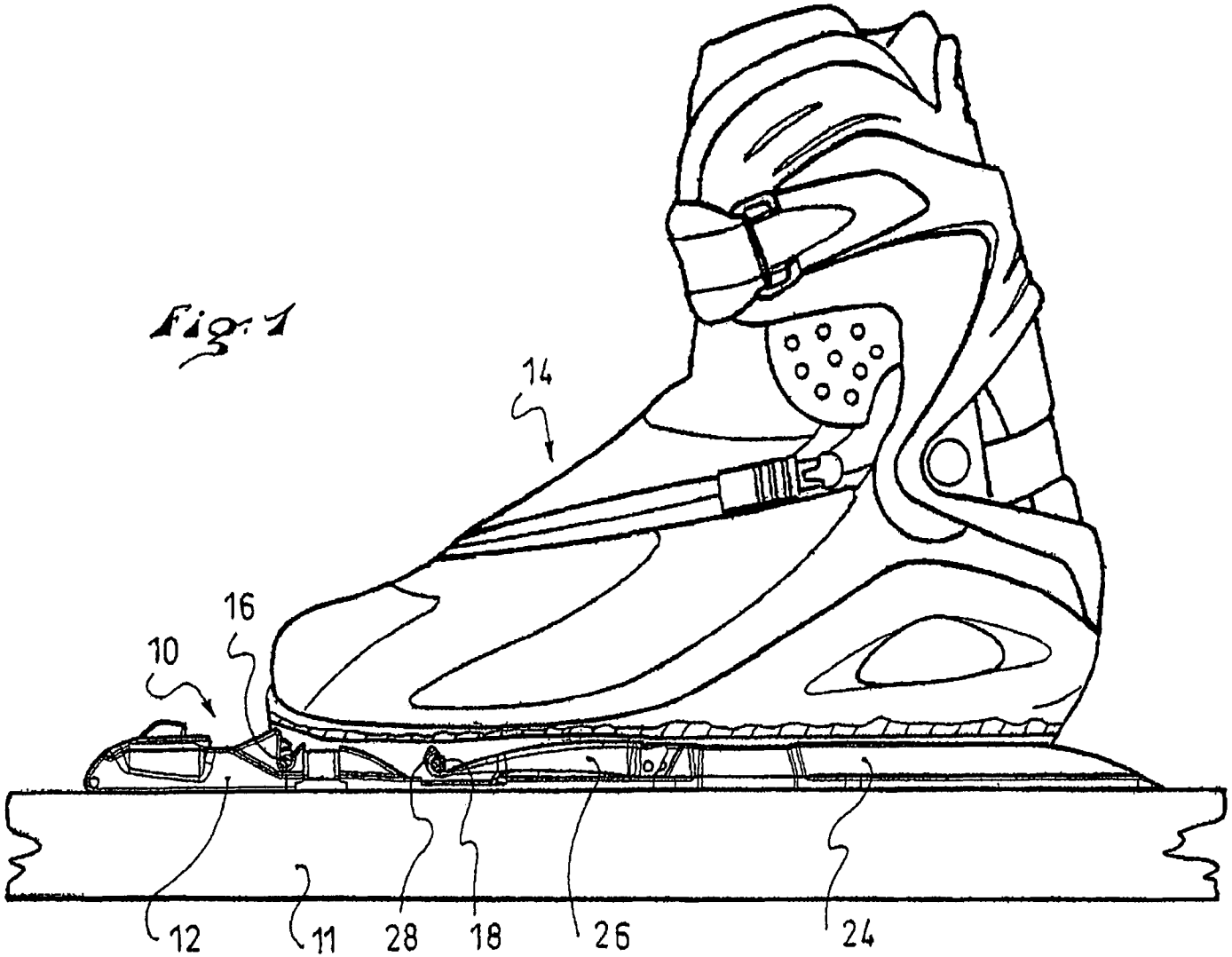
FIG. 1 is a schematic side view showing a cross-country ski boot mounted on a ski by means of a binding device according to the teachings of the invention.

The following description will be directed to embodiments of the invention in which the binding device, or binding, is more particularly adapted to cross-country skiing.

The first embodiment of a binding 10 shown in FIGS. 1 to 6 includes a baseplate 12, or base, which is adapted to be fixed to a sports article 11, here a ski, but which could also be directly integrated or made in one-piece with the ski. The baseplate 12 could also be made of different parts, some or none of these parts possibly being integrated to the sports article/ski 11.

In the example shown, the device is adapted to carry out the binding of a boot 14 including connecting means in two parts. The boot includes two connecting pins 16, 18, which are arranged in the boot sole so as to be flush below the sole. Connecting pins 16, 18 of this type are described in the patent documents EP-913 102, EP-913 103, and U.S. Pat. No. 6,289,610, the disclosure of U.S. Pat. No. 6,289,610 being herein incorporated by reference thereto in its entirety for this purpose. Thus, in the particular embodiment being described here, the pins take the form of two cylindrical rods positioned within the sole but extending across a longitudinal groove, preferably above the lowermost external surface of the sole and extending through a longitudinal median plane of the sole, thereby exposing an intermediate length of each of the pins for engagement with the binding. The front pin 16 is for example located in the vicinity of the front end of the sole and the rear pin 18 is offset toward the rear by a distance defined to be arranged in the area of, or at the front of a boot area corresponding to, the metatarsophalangeal bending zone of the user's foot. This arrangement of the connecting zones is particularly useful in cross-country skiing as it allows, with a boot having a flexible sole, the bending/flexing of the boot to correspond to that of the foot. However, the invention could be implemented with connecting members having another geometry or another configuration, for example, non-circular sectional rods, hooks, catching latches, or grooves formed directly in the same material as the sole, etc.

The front pin 16 is adapted to cooperate, in a known manner, with a latching mechanism 19, or locking mechanism, including a movable jaw 20, in the form of a hook, and a transverse edge/surface 22 of the baseplate constituting a stationary jaw for the rotational locking of the boot to the sports article. Once locked in the locking system, the front connecting pin 16 can freely rotate inside the jaw about the axis of the pin, therefore providing an articulated binding of the front end of the boot.

The rear pin 18 is adapted to be fastened to an elastic return system that is integrated into a guiding rib 24 of the device. As shown in FIG. 1, the guiding rib projects upward from the ski 11 and is received in a complementary recess in the sole of the boot 14. Such elastic return system is disclosed, for example, in the documents EP-768 103 and U.S. Pat. No. 6,017,050, commonly owned herewith. The disclosure of U.S. Pat. No. 6,017,050 is herein incorporated by reference thereto in its entirety for this purpose. It thus includes a connecting rod 26, or linkage, having a hook-shaped front end 28 (adapted to be fixed to the rear pin 18), and a rear end connected to the baseplate 12 so as to be able to longitudinally slide and rotate around a transverse axis. An elastic return mechanism (not shown in the drawings herein), such as a spring, applies an elastic force to bring the connecting rod 26 back to the resting position, shown in FIG. 1. Therefore, when the heel of the boot is raised by pivoting the boot around its front pin 16, the connecting rod 26, hooked to the rear pin 18, can follow the upward and frontward displacement of the rear pin 18 while exerting a return force on the latter that tends to bring the sole of the boot back toward the upper surface of the ski.

The invention can also be implemented for devices including other elastic return mechanisms, for example, including at the front of the binding an elastic buffer against which the front end of the boot is engaged when the heel of the boot is raised. In the latter case, according to the scope of the invention, the boot could therefore be provided with only one connecting pin/rod.

Figure 5:
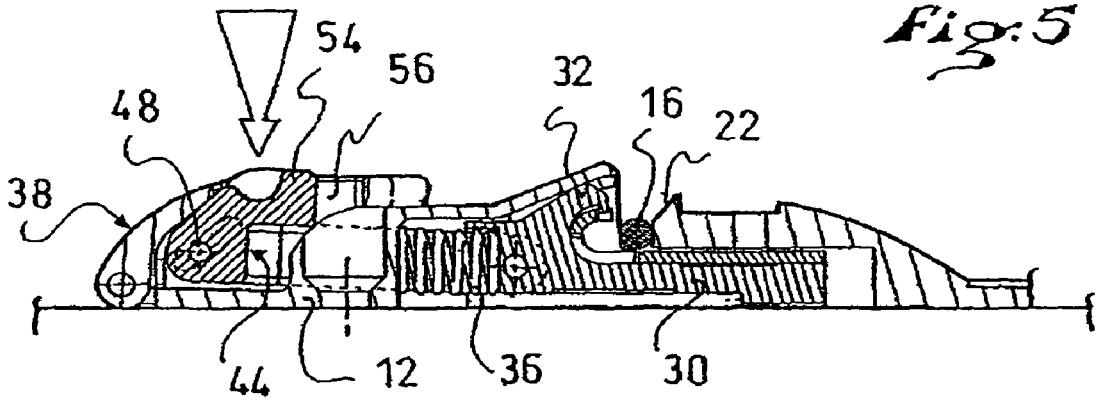
FIGS. 5 and 6 are views similar to that of FIG. 3, showing the two directions for manipulating the opening mechanism of the device.
Figure 6:
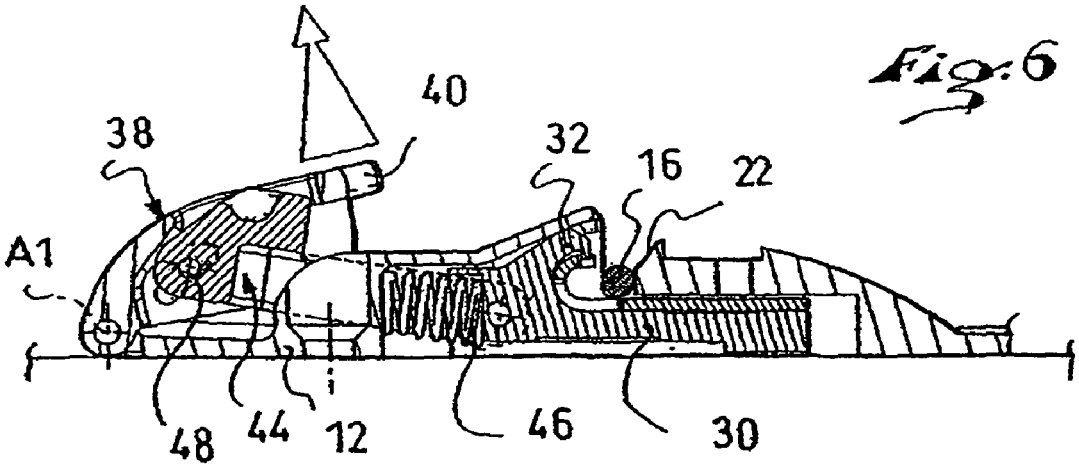

FIGS. 2 to 6 more particularly show the locking mechanism 19 of the front pin 16 of the boot. To facilitate the comprehension of the drawings, only the pin 16 of the boot is shown in FIGS. 3, 5, and 6. The operating principle of the locking mechanism here is known from the prior art (as, for example, in the bindings marketed by Salomon S.A. under the name "SNS Profil Auto"), and is therefore described herein for information purposes only, although the scope of the present invention encompasses the utilization of other types of locking mechanisms.

As mentioned above, the locking mechanism 19 essentially includes a movable piece 30, or slide, that is longitudinally movable between a rear locking position (shown in FIG. 3), and a front unlocking position (FIGS. 5 and 6). The slide can be made from a molded plastic material, for example, and includes an upper hook 32, or hook-shaped part, curved forwardly and then rearwardly. The slide can include a metallic reinforcement 34 that protects the inner surface of the hook 32, the inner surface being adapted to form a housing for the pin of the boot. Indeed, when the slide 30 is in a setback position, i.e., a rearward position, the hook 32 is positioned opposite the transverse edge 22 of the baseplate 12 so as to demarcate a housing with the latter, transversely open at its two ends, able to receive the pin 16. When the pin 16 is received in the housing and the slide is in the setback position, the pin is locked and can only rotate around its axis. Conversely, when the slide 30 is brought toward its forward position, the housing becomes opens at the top, allowing the pin to exit outside of the housing or to be again inserted into the housing.

Additional examples of bindings 10, which are described below, are provided with self-locking mechanisms. Indeed, it is apparent that the locking mechanism includes a compression spring 36 supported on the baseplate 12, on the one hand, and on the slide 30, on the other hand, to push the slide toward its rearward locking position. Furthermore, it is apparent that the hook 32 of the slide and the transverse edge 22 include portions of ramps in the form of a V-shaped structure. A user can therefore engage the front pin 16 of his/her boot bearing on the hook ramps and the transverse edge of the baseplate and, by a mere vertical force and due to the ramps, make the hook move forward against the action of the spring 36. Once the slide 30 has moved forward sufficiently, the pin 16 can engage inside the housing and the spring 36 can trigger the return of the slide 30 toward its locking position in which the hook 32 prevents the pin from withdrawing from the housing. Such a self-locking locking mechanism is advantageous in that it allows the boot to be locked on the binding without any particular action from the user, unlike other mechanisms in which the locking of the boot requires one or several manual operations of the user.

In a known manner, the binding includes a user-manipulable opening system for controlling the opening of the locking mechanism. However, according to a particular feature of the invention, the opening system is configured and arranged to be independently manipulated, directly or indirectly, according to either of at least two distinct directions of manipulation for controlling the opening mechanism. This is further described below.

In the examples described, the opening of the locking mechanism requires the triggering of the longitudinal forward displacement of the slide 30 from its rear locking position to its open front position. With other locking mechanisms, the opening control could require controlling other movements of the movable element (translational motion, rotational motion, or a combination of the two motions), and/or the same type of movement, but in a different direction.

In the first embodiment of the invention, the opening mechanism is located at the front end of the binding and includes two distinct control members, each manipulable according to one of the at least two directions of manipulation.

The first control member is a lever 38 that is articulated by its front articulation end on the baseplate 12 around a transverse axis A1. The lever is extended by a prehension arm 40, which, in its resting position shown in FIGS. 2 to 4, extends substantially horizontally and toward the back above the baseplate 12. The baseplate is provided with recesses 42 on its lateral surfaces that allow rendering the lateral edges of the lever's 38 prehension arm 40 very accessible to the user's hand.

The second control member is a slider 44, the rear end of which is connected to the slide 30 by means of an articulation rod 46 having a transverse axis A2. The articulation rod 46 affixes the slider 44 to the slide 30 in translation. The front end of the slider 44 is connected to the lever 38 by means of a connecting rod 48 having a transverse axis A3. The rod 48 transversely extends through the front end of the slider 44 and has two transverse end portions, which are received in the slots 50 arranged in parallel flanges 52 of the lever 38, flanges that vertically and longitudinally extend under the prehension arm 40. Two flanges 52 transversely frame the front of the slider 44, and the two slots 50 are angled about 45 degrees forwardly and downwardly. The connecting rod 48 connects the slider 44 to the lever 38 by allowing the two elements to have movements that are relative in translation and in rotation.

In addition, the slider 44 includes, in its front portion, a head 54 that extends toward the top so as to outwardly project through an opening 56 housed at the center of the prehension arm 40 of the lever 38.

At rest, such as shown in FIGS. 2 to 4, the lever 38 is supported in a low position on the baseplate, whereas the slider 44, under the effect of spring 36 and via the slide 30, is in a high setback position in which the connecting rod 48 that is connected to the slider 44, is received substantially at the high rear end of the angled slots 50 of the lever 38.

According to the invention, the user can trigger the opening of the locking mechanism with either of two distinct actions.

First, as can be seen particularly in FIG. 5, the user can exert a substantially vertical pressure from the top to the bottom on the head 54 of the slider 44, for example, with his/her hand or with the end of a ski pole (the use of a pole enabling him/her to open the device without having to bend down). As a result of this pressure, the connecting rod 48, which is connected to the slider 44 slides in the slots 50 of the lever 38. Indeed, the lever 38 then remains immobile since it is in abutment on the baseplate 12. By sliding in the angled slots 50, the connecting rod 48 triggers a transformation of the vertical force exerted by the user in a combined movement of the slider 44 (like in a system with a cam), this movement being the combination of a frontward longitudinal translation with a rotation around axis A2 (in the counter-clockwise direction in the drawings). Because the slider 44 and the slide 30 are connected by a pivot connection, the longitudinal translation component of the slider 44 movement is directly transmitted to the slide 30, which is thus controlled toward its front position for opening. As soon as the user releases force on the head 54 of the slider 44, the spring 36 brings the slider 44 back to its resting position, and, at the same time, the slide 30 toward its rear locking position.

Second, as shown in FIG. 6, the user can grab the prehension arm 40 of the lever 38 and lift it upwardly, thereby triggering a rotation of the lever around the axis A1 (in the counter-clockwise direction in the drawings). By means of this rotational movement, the slots 50 of the flanges 52 of the lever 38 drive with them the connecting rod 48 that is affixed to the slider 44. The slider 44 is thus driven forwardly, taking with it the slide 30 toward its front unlocking position. As in the case of the first distinct opening action, as soon as the user releases the lever 38, the spring 36 brings the slide 30 and the slider 44 back toward their resting positions, and the latter brings, by means of the connecting rod 48, the lever 38 back toward its initial position.

In accordance with the invention, there are therefore two different ways of manipulating the opening system. The first way is by means of a pressure exerted substantially downward. The second way is by means of a substantially upwardly directed traction force. The user will therefore be able to choose anytime the most practical manner for him/her to control the opening of the mechanism. Each of the two control members, i.e., the slider 44 and the lever 38, are external to the article of footwear, i.e., the boot in this embodiment, and accessible externally of the article of footwear.

In this first embodiment, the slider 44, when downwardly manipulated, directly controls the opening of the locking mechanism, and the lever 38, when upwardly manipulated, controls the opening of the mechanism by means of the slider 44, thus indirectly. In addition, the two control members move according to different types of movements. The locking mechanism and its opening system share a single elastic return member, that is, the spring 36.

Other embodiments of the invention, described below with reference to the drawings, are directed to various possible systems, within the scope of the invention, for controlling the opening. These embodiments are described in the realm of bindings, the locking mechanism of which is implemented under the form of a sliding member, or slide, such as the one just described in greater detail. Other mechanisms are contemplated within the scope of the invention, the following of which are exemplary. In view of the foregoing description of an embodiment according to the invention, with which certain features of the invention have been explained, the descriptions of the following alternative embodiments are somewhat less elaborate, yet sufficient for one skilled in the art to make and use them. The same reference numerals as used above have been retained for the same or similar elements. Indeed, in order to facilitate their understanding, the functional drawings figures to which the following descriptions are directed do not show the elastic return systems of the locking mechanisms and/or of the members for controlling their opening. One having ordinary skill in the art will be able to easily adapt known return systems, for example, systems similar to the system of which spring 36 is a part, described above.

Figure 7:
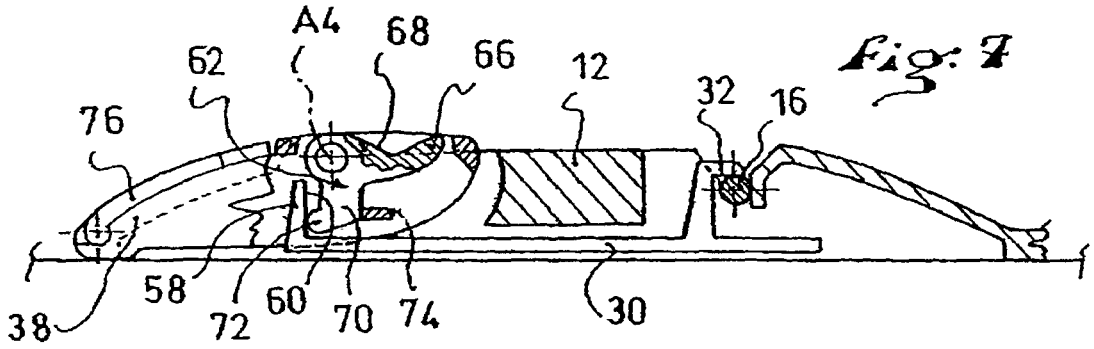
FIG. 7 is a schematic partial, longitudinal cross-sectional view of a second embodiment of a binding device according to the invention.
Figure 8:
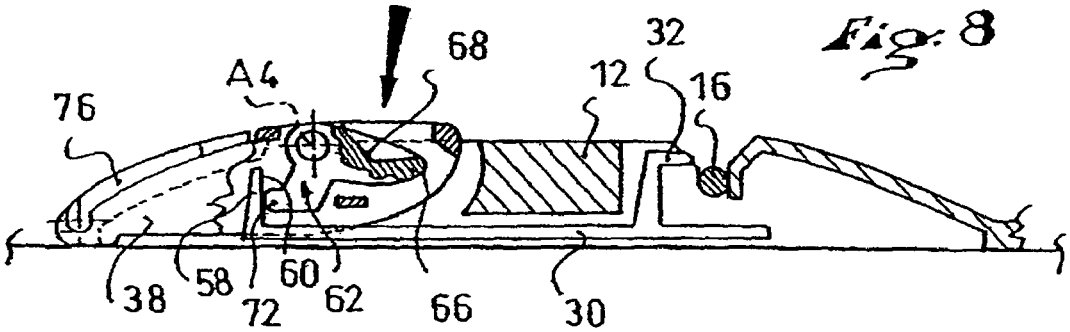
FIGS. 8 and 9 are views to that of FIG. 7, showing the two directions for manipulating the opening mechanism of the device.
Figure 9:
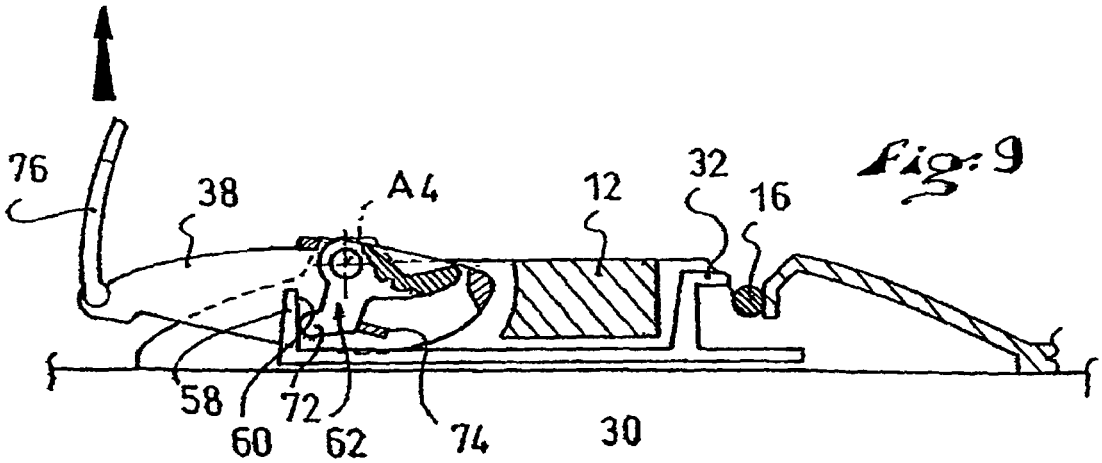

The second embodiment of the invention shown in FIGS. 7 to 9 also includes two distinct members for controlling the opening, but, unlike the first embodiment, these two members, when manipulated by the user, move with the same type of movement, that is, a rotational movement.

Thus, the slide 30 of the locking mechanism includes a forward extension ended with a raised nose 58 including a support surface 60 that is substantially vertical and turned rearward.

The opening system includes a lever 38 articulated on the baseplate 12 about a transverse axis A4. A rocking member 62, or rocker, is articulated on the lever and/or on the baseplate about the same axis A4. It could also be articulated on an axis offset with respect to the axis A4.

The rocker 62 includes two substantially perpendicular arms, which extend substantially radially from the axis A4. An upper arm 66 extends rearwardly along a substantially horizontal direction and has an upper surface 68, generally convex, although not limited to such contour, on which a user can exert a downward vertical pressure, for example with a ski pole. A lower arm 70 extends substantially downward and includes a control finger 72 that is forwardly supported against the support surface 60 of the raised nose 58 of the slide 30. When the user pushes downward on the upper arm 66, 68 (see the arrow in FIG. 8), he/she triggers a rotation of the rocker 62 about its axis A4 (in the clockwise direction in the drawings), the finger 72 of the rocker 62 then forwardly pushing the raised nose 58 of the slide up to its front unlocking position.

In addition, an abutment 74 is provided to limit the extent of the rotation of the rocker 62 in one of the two directions. The lever 38 carries the abutment.

When the front end of the lever 38 is grabbed by the user and raised upwardly (c.f. FIG. 9), such motion triggers a rotation of the lever 38 about the axis A4; but it also triggers, by means of the abutment 74, the rotation of the rocker 62, which, as shown above, triggers the forward displacement of the slide 30. In the example shown, the lever 38 includes a member 76, shown as pivoted to the lever 38, that can be raised upwardly, which facilitates the grasping and manipulation of the lever. However, the member 76 is optional; it could be replaced by a flexible cord or by a specific geometry of the lever, or it could even be omitted, the member 76 not being an independent control member for the lever 38.

In the embodiment of FIGS. 7 to 9, the opening system includes two control members: the rocker 62 that directly controls the opening of the locking mechanism, independently from any displacement of the second control member, and the lever 38 that indirectly controls the mechanism by means of the rocker 62.

Figure 10:
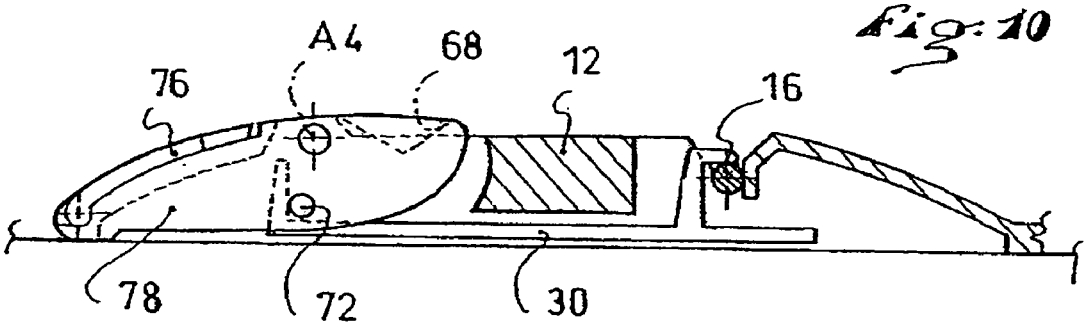
FIGS. 10, 11, and 12 are views similar to those of FIGS. 7, 8, and 9, showing a third embodiment of the invention.
Figure 11:
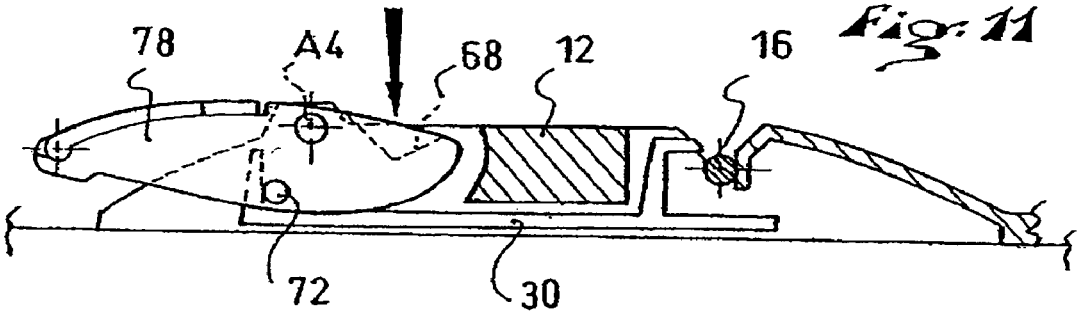
Figure 12:
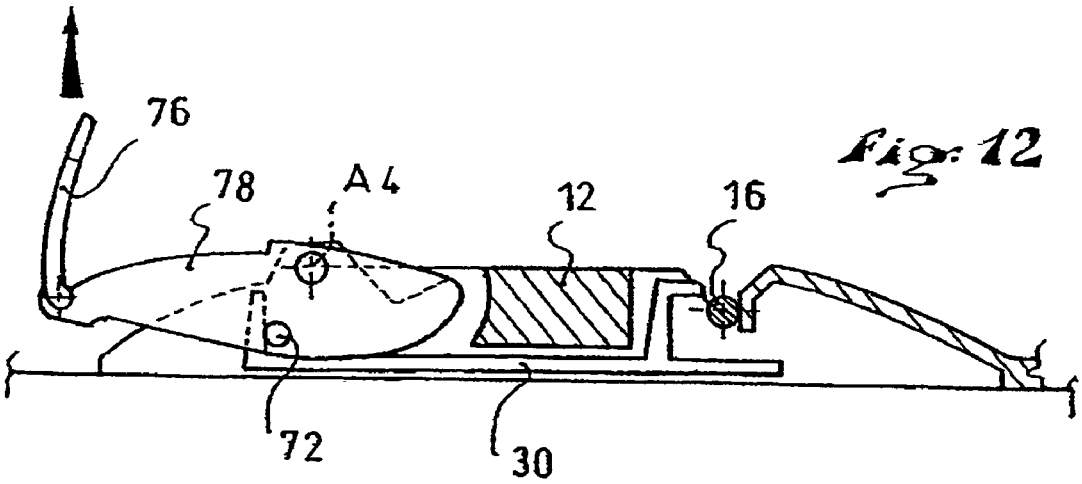

A third embodiment of the invention is shown in FIGS. 10 to 12, in which the system for opening the locking mechanism includes only one control member. As illustrated in the drawings, the system is identical to the preceding one, except that the lever and the rocker are made as one and only piece: the rocker 78 articulated on the baseplate 12 about the axis A4, and which includes an upper support surface 68 arranged rearward from the axis A4, on the one hand, and front prehension arrangement (i.e., the member 76) arranged forward from the axis A4, on the other hand, and so as to trigger the same tipping move of the rocker 78, the user can choose to downwardly push on the rear surface 68, or to upwardly pull the front prehension member 76. In either case, the rocker revolves about the axis A4 and, by means of a control finger 72, controls the forward translation of the slide 30.

Figure 13:
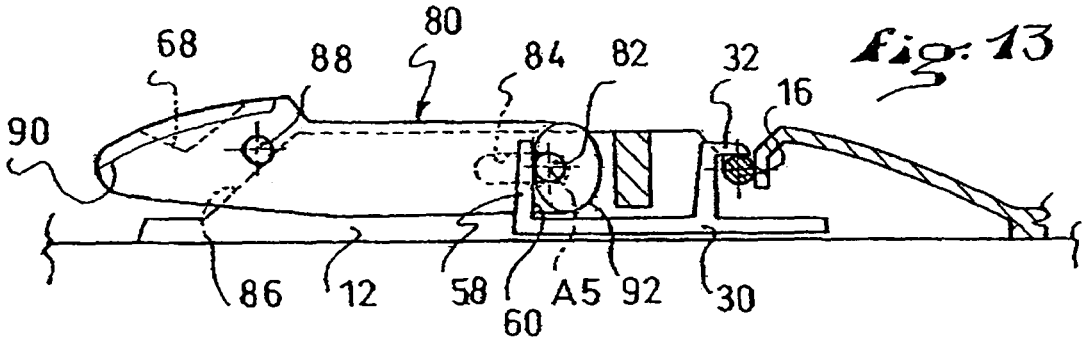
FIGS. 13, 14, and 15 are views similar to those of FIGS. 7, 8, and 9, showing a fourth embodiment of the invention.
Figure 14:
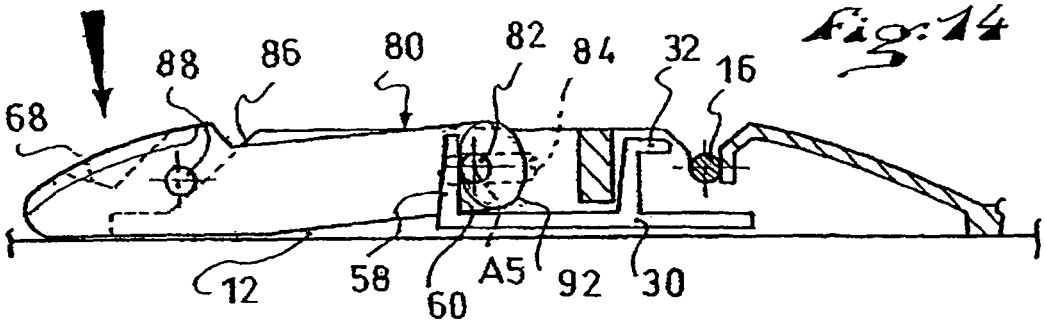
Figure 15:
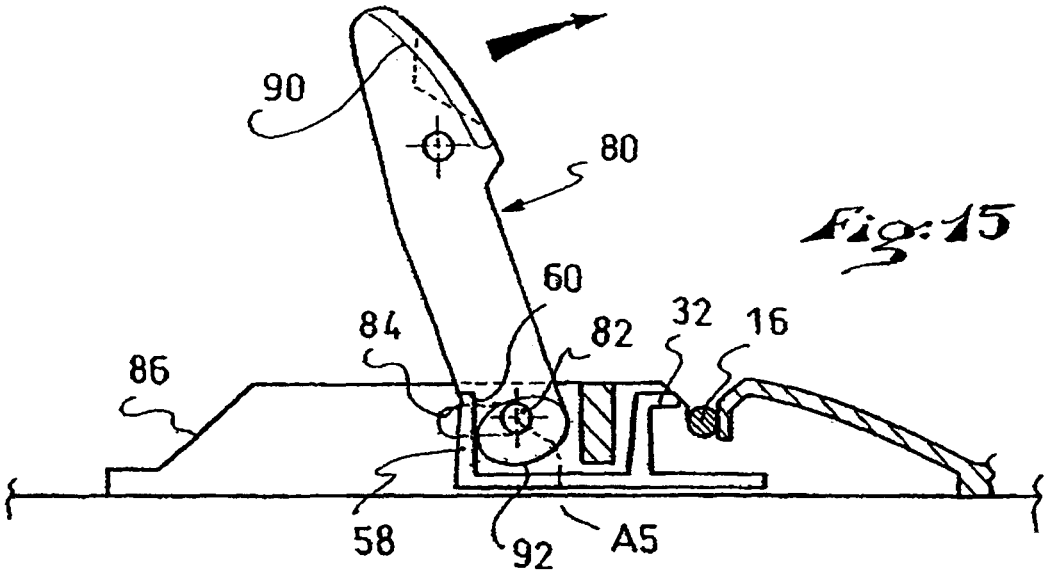

The fourth and fifth embodiments of the invention shown, respectively, in FIGS. 13-15 and in 16-18, also include a single control member for opening the locking mechanism, which is, according to the invention, capable of being manipulated independently according to two distinct directions of manipulation for controlling the mechanism opening. However, unlike the previous embodiment, the two directions of manipulation correspond to movements of the locking member that are not of the same type.

Therefore, in both cases, the control member is a lever 80 connected to the baseplate 12 by means of a connecting rod 82. This connecting rod 82 having a transverse axis A5 is affixed to the rear end of the lever 80 and is received in a slot 84 of the baseplate 12 (or in several parallel slots). The slot 84 is substantially rectilinear and is extended along the longitudinal direction so that the connection between the lever 80 and the baseplate 12 allows the lever to rotate about the axis A5 and to longitudinally translate. In addition, the lever 80 is supported at its front end on an inclined surface 86 of the baseplate. The inclined surface 86 is a surface facing both upwardly and forwardly, the shape of which is therefore downwardly and forwardly inclined. The lever 80 has, for example, a pin or a roller 88 that is in contact with the inclined surface 86. In addition, the lever 80 has, at its front end, an upper support surface 68 on which the user can exert a substantially vertical, downward force, and lateral edges 90 providing a surface that can facilitate prehension and manipulation by the user, thereby enabling the user to effectively grab and manipulate the front end of the lever 80 so as to raise it upwardly. The lever 80 is thusly connected to the baseplate 12 by means of a connection having at least two degrees of freedom.

In the fourth embodiment shown in FIGS. 13 to 15, the lever includes at its rear end a cam 92, which is arranged about the axis A5 and is adapted to be supported against the rear support surface 60 of the raised nose 58 arranged at the front of the slide 30. The eccentricity of the cam 92 is such that when the user triggers the lifting of the lever 80 by pulling its front end upwardly, the lever 80 then turns about the axis A5 of the connecting rod 82, the surface of the cam 92 pushes the slide 30 forwardly (c.f. FIG. 15). The lever 80 cannot translate rearwardly with respect to baseplate 12 because the connecting rod 82 is blocked toward the rear against the rear end of the slot 84. The movement of the lever is therefore a true rotation.

When the user pushes on the support surface 68 of the lever downwardly, the pin 88 tends to slide on the inclined surface 86 so as to trigger (by a cam effect) a forward translation of the lever 80. This translation is allowed since the connecting rod 82 can then translate forwardly in the slot 84. The lever 80 translation is thus accompanied by a slight rotation of the lever about the axis A5 of the rod, but it is substantially the overall translation of the lever that makes it drive with it the slide 30, by means of the cam surface 92.

Figure 16:
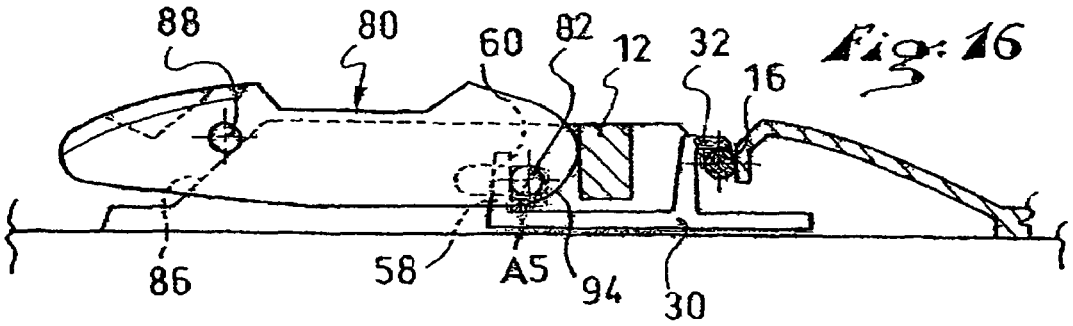
FIGS. 16, 17, and 18 are views similar to those of FIGS. 7, 8, and 9, showing a fifth embodiment of the invention.
Figure 17:
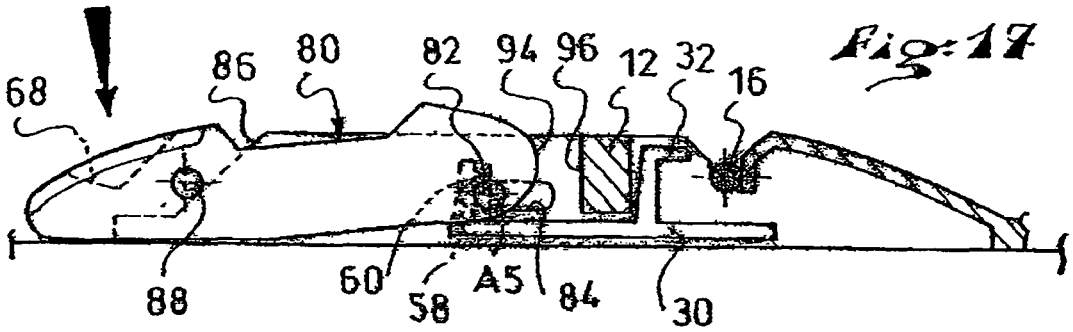
Figure 18:
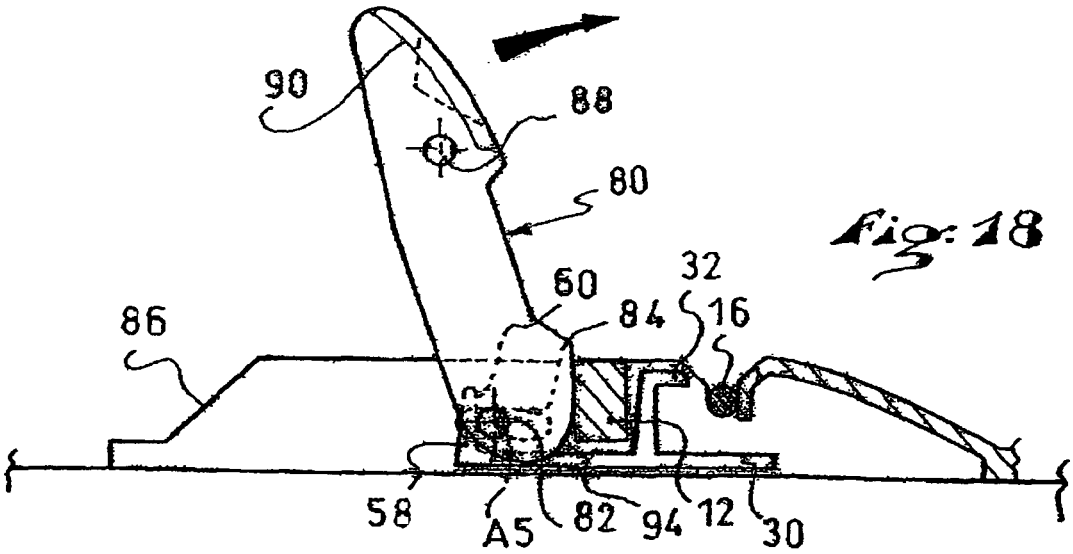

The fifth embodiment shown in FIGS. 16 to 18 differs from the previous one only by the fact that the rod 82 is in contact with the rear surface 60 of the raised nose 58 of the slide 30, and by the fact that the lever includes a rear surface that forms a cam 94 adapted to be supported against the corresponding contact surface 96 of the baseplate 12.

When the user pushes on the upper support surface 68 of the lever (see FIG. 17), the lever 80 translates forwardly, as in the previous embodiment, and drives the slide 30, this time by means of the connecting rod 82.

When the user lifts the front end of the lever 80 (see FIG. 18), the cam 94 triggers, as a function of the lifting angle, a forward, horizontal translation of the rear end of the lever. This translation is then directly passed on the slide 30 by the connecting rod 82. Here, the movement of the lever is a combination of a rotation and a translation movement.

Figure 19:
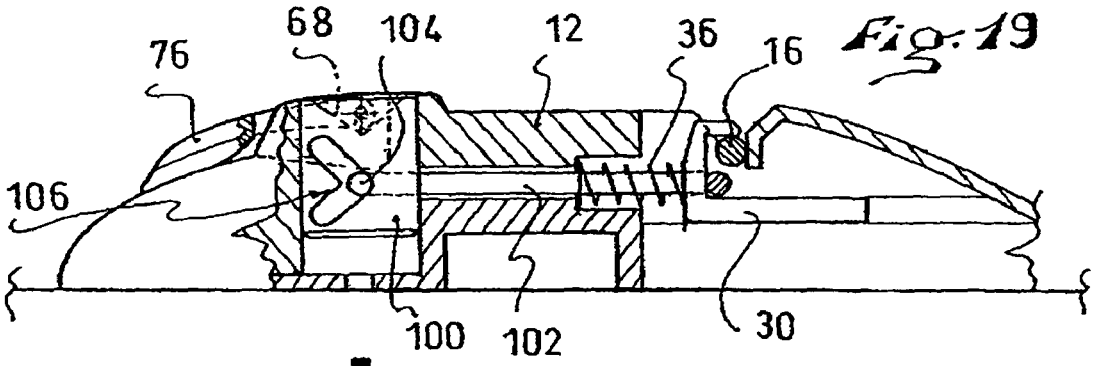
FIGS. 19, 20, and 21 are similar views than those in FIGS. 7, 8, and 9 showing a sixth embodiment of the invention.
Figure 20:
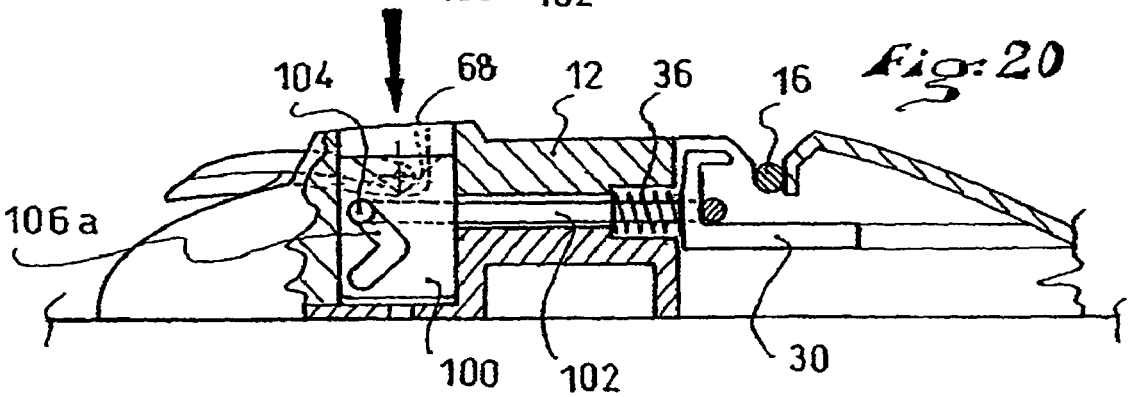
Figure 21:
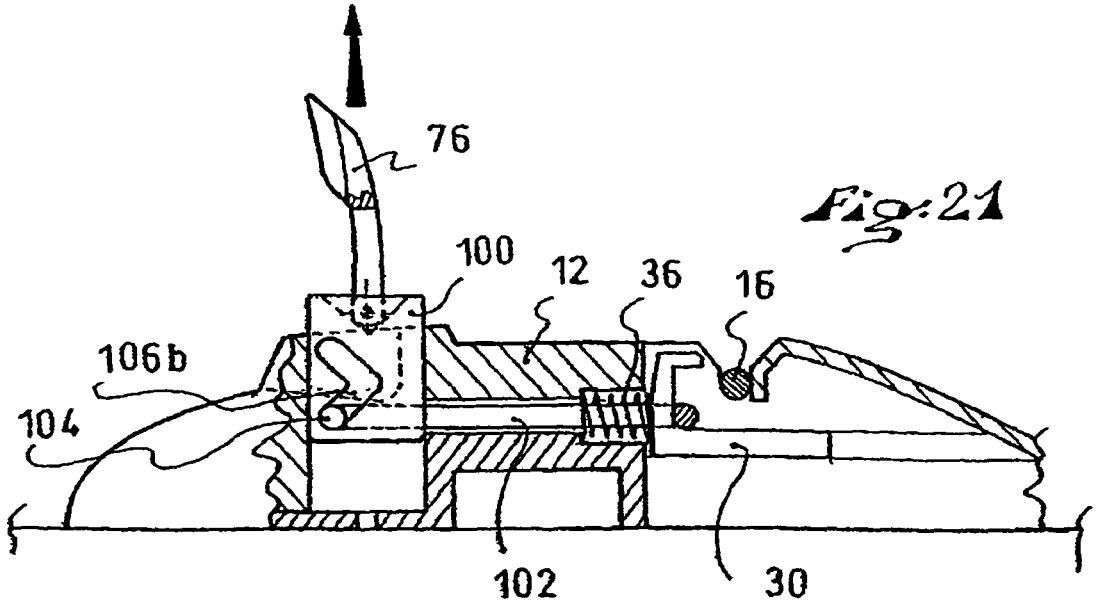

In the sixth embodiment of the invention shown in FIGS. 19 to 21, the opening system includes a single control member, which is a sliding member 100, or sliding block, movably mounted in upward translation relative to the baseplate 12. The member 100 is provided with a central locking position (FIG. 19) and two opening positions, high and low (see FIGS. 20 and 21). The member 100 is connected to the slide 30 by means of a connecting element 102 mounted in the baseplate 12 so as to be able to slide longitudinally only. The front end of the connecting element 102 includes a transverse pin 104, which is received in a slot 106 formed in the sliding member 100. The slot 106 includes two arms: an upper arm 106*a* upwardly and forwardly oriented, and a lower arm 106*b*, downwardly and forwardly oriented. In a side view such as shown in the drawings, the slot 106 therefore has a V-shaped profile, the point of which is longitudinally directed toward the rear. When the sliding member 100 is in the central position, the pin 104 of the connecting element is engaged in the slot 106 at the intersection of the two arms, at the V point.

When the user pushes the sliding member 100 downwardly, the pin 104, which can not move vertically, is forced toward the front by the upper arm 106*a* of the slot (FIG. 20), driving the connecting element 102 and the slide 30 forwardly.

For the manipulation of the sliding member 100, the exemplary embodiment illustrated has been provided, as an example, an upper support surface 68 and a retractable pivoted pull rod 76.

Each of the exemplary embodiments of the binding, described herein, has a construction that is particularly ergonomic, facilitating manipulation by the user under any circumstance. In the embodiments featuring two distinct control members, the ease of use is favored while having the possibility of adapting the geometry of the control member to the better, or preferred, of two modes of manipulation. Thus, depending on whether the control member must be, for example, pulled or pushed, the control surfaces can be better specified in order, for example, to facilitate the manual prehension or support with an accessory. One will also be able to easily design control members having features such as lever arms adapted to the force that the user can exert according to the corresponding direction of manipulation, this, in order to control with an equivalent ease, the locking mechanism according to the two directions of manipulation. In the embodiments featuring a single control member, the simplicity, low manufacturing cost, and operating reliability has been emphasized. Depending on the practice for which the binding is adapted, or the type of user for which the binding is adapted, which is an objective, one can thus choose one or the other of the embodiments, or even other embodiments encompassed within the disclosure of those that are shown and/or described.

The invention claimed is:

1. A device for binding an article of footwear to a sports article, said device comprising:

a locking mechanism adapted to cooperate with a connecting member of an article of footwear to provide an articulated binding of the article of footwear, said locking mechanism comprising a slide constructed and arranged to move in translation between an open position, to allow entry and exit of the connecting member of the article of footwear from said locking mechanism, and a closed position, to lock the article of footwear relative to the sports article;

a user-manipulable opening system for controlling movement of said locking mechanism to said open position, said opening system being directly or indirectly manipulable, externally of the article of footwear, and independently according to any of at least two distinct directions of manipulation for controlling said movement of said locking mechanism to said open position;

said locking mechanism comprising a movable jaw and a fixed jaw;

said movable jaw being structured and arranged to move in translation with said slide between said open and closed positions of the locking mechanism;

from the closed position to the open position of the locking mechanism, said movable jaw moves away from said fixed jaw and away from the article of footwear to allow said entry and exit of the connecting member of the article of footwear between said movable jaw and said fixed jaw.

2. A device according to claim 1, wherein:

said opening system includes a single control member, said single control member being manipulable according to at least two distinct directions of manipulation.

3. A device according to claim 2, wherein:

the two directions of manipulation are substantially opposite.

4. A device according to claim 2, wherein:
the two directions of manipulation correspond to movements of the control member of the same type.

5. A device according to claim 2, wherein:
said control member is a rocker, said rocker being movable about an axis, said rocker including two surfaces of manipulation extending through said axis.

6. A device according to claim 2, wherein:
the two directions of manipulation correspond to different types of movements of the control member.

7. A device according to claim 6, wherein:
said control member is connected to a baseplate of the device by a connection having at least two degrees of freedom.

8. A device according to claim 2, wherein:
said control member includes at least a cam system to transform a movement of the control member into a movement for opening the locking mechanism.

9. A device according to claim 1, wherein:
said locking mechanism is automatic/self-locking.

10. A device according to claim 9, wherein:
said locking mechanism includes an elastic return means, said elastic return means also acting upon said opening system.

11. A device according to claim 1, wherein:
said opening system comprises a control member, said control member including at least a cam system to transform a movement of the control member into a movement for opening the locking mechanism.

12. A device according to claim 1, wherein:
said opening system comprises a control member structured and arranged to be accessible to a wearer of the article of footwear external to the article of footwear, said control member extending forwardly of the article of footwear with the article of footwear locked in the closed position of the locking mechanism.

13. A device according to claim 1, wherein:
the connecting member of the article of footwear extends through a longitudinal median plane of a sole of the article of footwear;
the locking mechanism comprises a jaw adapted to engage the connecting member of the article of footwear.

14. A device according to claim 1, wherein:
the locking mechanism is structured and arranged to engage with at least one connecting member of the article of footwear located in, or forward of, a metatarsophalangeal bending zone, whereby the articulated binding of the article of footwear, while the locking mechanism is in the locked position, provides for a raising and lowering of a heel of the article of footwear relative to the sports article and allows flexing of the article of footwear in a flexion zone of the article of footwear.

15. A device according to claim 1, further comprising:
a guiding rib extending longitudinally and rearwardly of the locking mechanism and being receivable in a complementary recess in a sole of the article of footwear for guiding movement of the sole of the article of footwear during use of the device.

16. A device according to claim 1, wherein:
said device is structured and arranged to require direct manipulation of said opening system by the user externally of the article of footwear to move the locking system to said open position.

17. A device according to claim 1, wherein:
said locking mechanism comprises a housing movable in translation with said slide;
said housing, in said open position of the locking mechanism, is upwardly open to allow said entry and said exit of the connecting member of the article of footwear and, in said closed position of the locking mechanism, is closed to prevent exit of the connecting member of the article of footwear.

18. A device according to claim 17, wherein:
the connecting member is a pin extending transverse of the longitudinal extent of the article of footwear;
the housing of the locking mechanism is structured and arranged to house said pin in said closed position of the locking mechanism.

19. A device according to claim 17, wherein:
the connecting member is a transversely extending cylindrical rod extending across a longitudinal groove of the article of footwear;
the housing of the locking mechanism is structured and arranged to house said cylindrical rod in said closed position of the locking mechanism.

20. A device according to claim 1, wherein:
the connecting member is a pin extending transverse of the longitudinal extent of the article of footwear;
the user-manipulable opening system is structured and arranged to move the movable jaw away from the fixed jaw a distance to allow entry and exit of the cylindrical rod between the fixed and movable jaws in said open position of the locking mechanism.

21. A device according to claim 1, wherein:
the connecting member is a transversely extending cylindrical rod extending across a longitudinal groove of the article of footwear;
the user-manipulable opening system is structured and arranged to move the movable jaw away from the fixed jaw a distance to allow entry and exit of the cylindrical rod between the fixed and movable jaws in said open position of the locking mechanism.

22. A device for binding an article of footwear to a sports article, said device comprising:
a locking mechanism adapted to cooperate with a connecting member of an article of footwear to provide an articulated binding of the article of footwear, said locking mechanism movable between an open position, to allow entry and exit of the connecting member of the article of footwear from said locking mechanism, and a closed position, to lock the article of footwear relative to the sports article;
a user-manipulable opening system for controlling movement of said locking mechanism to said open position, said opening system being directly or indirectly manipulable, externally of the article of footwear, and independently according to any of at least two distinct directions of manipulation for controlling said movement of said locking mechanism to said open position;
said opening system including at least two distinct control members, each of said control members being manipulable external of the article of footwear according to a respective one of the at least two directions of manipulation.

23. A device according to claim 22, wherein:
said opening system includes a first control member, said first control member being manipulable according to a first direction of manipulation directly controlling the opening of the locking mechanism, and a second control member, said second control member being movable according to a second direction of manipulation for controlling the opening of the mechanism by means of the first second control member.

24. A device according to one of claim 23, wherein:

said two control members are movable according to the same type of movements.

25. A device according to claim 24, wherein:

said opening system includes a lever and a rocker movable according to a pivoting motion, said rocker being connected to a movable element of the locking mechanism to directly control the opening of the opening system;

said lever and said rocker are connected by an abutment whereby a rotation of said lever triggers a corresponding rotation of the rocker, said rotation of the rocker controlling the opening of said locking mechanism.

26. A device according to claim 25, wherein:

said rocker revolves independently relative to the lever.

27. A device according to claim 25, wherein:

said lever and said rocker rotate about the same axis.

28. A device according to one of claim 22, wherein:

said two control members are movable according to different types of movements.

29. A device according to claim 28, wherein:

said opening system includes a lever, mounted for pivotal movement, and a pivotal slider, said slider being connected to a movable element of the locking mechanism to directly control opening of the locking mechanism;

said lever and said pivotal slider are connected whereby pivoting of the lever triggers a corresponding movement of the pivotal slider, said movement including at least a translation component, thereby triggering opening of the locking mechanism.

30. A device for binding an article of footwear to a sports article, said device comprising:

a locking mechanism comprising a jaw adapted to cooperate with a part of an article of footwear, said jaw movable between an open position, to allow entry and exit of said part of the article of footwear from the locking mechanism, and a closed position, to lock said part of the article of footwear relative to the sports article to provide an articulated binding of the article of footwear;

a user-manipulable opening system for controlling movement of the jaw of the locking mechanism from the closed position to the open position, said opening system comprising:

a first control member accessible to a wearer of the article of footwear external to the article of footwear; and a second control member accessible to a wearer of the article of footwear external to the article of footwear;

each of said first and second control members is structured and arranged to be manipulable independently of the other to move the jaw of the locking mechanism from the closed position to the open position.

31. A device according to claim 30, wherein:

the first control member is structured and arranged to move the jaw of the locking mechanism from the closed position to the open position upon the exertion of a force in a first direction; and the second control member is structured and arranged to move the jaw of the locking mechanism from the closed position to the open position upon the exertion of a force in a second direction, said second direction being different from said first direction.

32. A device according to claim 31, wherein:

the first control member includes a lever, mounted for pivotal movement, and a pivotal slider, said slider being connected to a movable element of the locking mechanism to directly control opening of the locking mechanism;

said lever and said pivotal slider are connected whereby pivoting of the lever triggers a corresponding movement of the pivotal slider, said movement including at least a translation component, thereby triggering opening of the locking mechanism.

33. A device according to claim 31, wherein:

each of the first and second control members is structured and arranged to be accessible to a hand of a user or a ski pole held by the user for said exertion of force to move the jaw of the locking mechanism from the open position to the closed position.

34. A device according to claim 30, wherein:

the first control member is structured and arranged to move the jaw of the locking mechanism from the closed position to the open position upon the exertion of a downwardly directed force; and the second control member is structured and arranged to move the jaw of the locking mechanism from the closed position to the open position upon the exertion of an upwardly directed force.

35. A device according to claim 30, wherein:

the articulated binding of the article of footwear is structured and arranged to enable a rear end of the article of footwear to move toward and away from the sports article in the closed position of the jaw of the locking mechanism.

36. A device according to claim 30, wherein:

said first and second control members are structured and arranged to extend forwardly of the article of footwear with the article of footwear locked in the closed position of the jaw of the locking mechanism.

37. A device according to claim 30, wherein:

said part of the article of footwear comprises at least one connecting member affixed to a sole of the article of footwear and extends through a longitudinal median plane of the sole of the article of footwear;

said jaw of the locking mechanism is structured and arranged to cooperate with said connecting member to lock said connecting member relative to the sports article to provide the articulated binding of the article of footwear.

38. A device according to claim 30, further comprising:

a guiding rib extending longitudinally and rearwardly of the locking mechanism and being receivable in a complementary recess in a sole of the article of footwear for guiding movement of the sole of the article of footwear during use of the device.

39. A device according to claim 30, wherein:

said device is structured and arranged to require direct manipulation of one of said first and second control members of the opening system by the user externally of the article of footwear to move the jaw of the locking system to said open position.

40. A device for binding an article of footwear to a sports article, said device comprising:

a locking mechanism comprising a jaw adapted to cooperate with a connecting member of an article of footwear, said jaw movable between an open position, to allow entry and exit of the connecting member of the article of footwear from the locking mechanism, and a closed position, to lock the article of footwear relative to the sports article;

a user-manipulable opening system for controlling movement of the jaw of the locking mechanism from the closed position to the open position, said opening system comprising:

a first control member accessible to a wearer of the article of footwear external to the article of footwear;

a second control member accessible to a wearer of the article of footwear external to the article of footwear;

each of said first and second control members is structured and arranged to be manipulable independently of the other to move the jaw of the locking mechanism from the open position to the closed position;

the first control member being structured and arranged to move the jaw of the locking mechanism from the closed position to the open position upon the exertion of a downwardly directed force; and the second control member being structured and arranged to move the jaw of the locking mechanism from the closed position to the open position upon the exertion of an upwardly directed force.

* * * * *